US007204720B1

(12) United States Patent
Shiu

(10) Patent No.: US 7,204,720 B1
(45) Date of Patent: Apr. 17, 2007

(54) POWER SUPPLY CONNECTOR ASSEMBLY DEVICE

(75) Inventor: Kuang-Hua Shiu, Jhongli (TW)

(73) Assignee: Singatron Enterprise Co., Ltd., Hsinchu County (TW)

( * ) Notice: Subject to any disclaimer, the term of this patent is extended or adjusted under 35 U.S.C. 154(b) by 0 days.

(21) Appl. No.: 11/335,677

(22) Filed: Jan. 20, 2006

(51) Int. Cl.
*H01R 24/04* (2006.01)

(52) U.S. Cl. ..... 439/668

(58) Field of Classification Search ..... 439/668, 439/669, 675, 580, 63, 581
See application file for complete search history.

(56) References Cited

U.S. PATENT DOCUMENTS 4,593,464 A * 6/1986 Williams et al. ..... 29/879
5,547,400 A * 8/1996 Wright ..... 439/668
5,562,506 A * 10/1996 Wright ..... 439/675
5,807,116 A * 9/1998 Kitatani et al. ..... 439/63
6,241,559 B1 * 6/2001 Taylor ..... 439/675
6,312,274 B1 * 11/2001 Lin ..... 439/188
6,322,397 B1 * 11/2001 Zhang ..... 439/668
6,695,644 B2 * 2/2004 Zhao et al. ..... 439/580

* cited by examiner

*Primary Examiner*—Gary F. Paumen
(74) *Attorney, Agent, or Firm*—Troxell Law Office, PLLC

(57) ABSTRACT

A power supply connector assembly device, having a power supply connector includes a front insulating body and a rear insulating body. The front insulating body with a holding cavity that is used to hold a first conductive terminal, and the first conductive terminal comprises holding slots that hold a protruding portion formed central of an insulating body. Embedding grooves are defined on the protruding portion that enable a second conductive terminal to embed therein, and a through hole is further defined in the protruding portion that provides for the signal terminal to clamp therein.

When joining together the front insulating body and the rear insulating body, joining holes defined in the front insulating body and joining portions formed on the rear insulating body, and the two insulating bodies are clamped and enclosed within a covering case, thereby enabling the power supply connector to achieve the objective of conducting electric power.

5 Claims, 8 Drawing Sheets

POWER SUPPLY CONNECTOR ASSEMBLY DEVICE

BACKGROUND OF THE INVENTION (a) Field of the Invention

The present invention relates to a power supply connector assembly device, and more particularly to a power supply connector having a structure including two insulating bodies.

(b) Description of the Prior Art

Referring to FIGS. 1 and 2, which show a prior art power connector A, wherein a first conductive body A2 and a second conductive body A3 are disposed within a holding cavity A4 of an insulating body A1, thereby enabling the power connector A to combine the first conductive body A1 and the second conductive body A3 into an integrated body. However, because of deformation in a contact portion A6 between the first conductive body A2 and the second conductive body A6 when connecting the power connector A to a power plug A5, thus, a poor contact results with the power connector A after plugging and unplugging multiple times. Moreover, poor contact between the first conductive body A2 and the second conductive body A3 results in the power connector A being unable to achieve the objective of good electrical conductance.

Hence, the present invention herein discloses a new and improved configuration to resolve and surmount existent technical difficulties to eliminate the aforementioned shortcomings.

SUMMARY OF THE INVENTION

The present invention provides a power supply connector assembly device, wherein a power supply connector has a structural configuration that utilizes two insulating bodies, so that when contact portions of a first conductive terminal and a second conductive terminal make contact with uniformly distributed inner and outer contact portions of an electric plug, then the contact portions of the first conductive terminal and the second conductive terminal provide even support between the power supply connector and the electric plug, thereby achieving a good and stable electrical connection between the power supply connector and the electric plug.

To enable a further understanding of said objectives and the technological methods of the invention herein, brief description of the drawings is provided below followed by detailed description of the preferred embodiments.

DETAILED DESCRIPTION OF THE PREFERRED EMBODIMENTS

Figure 1:
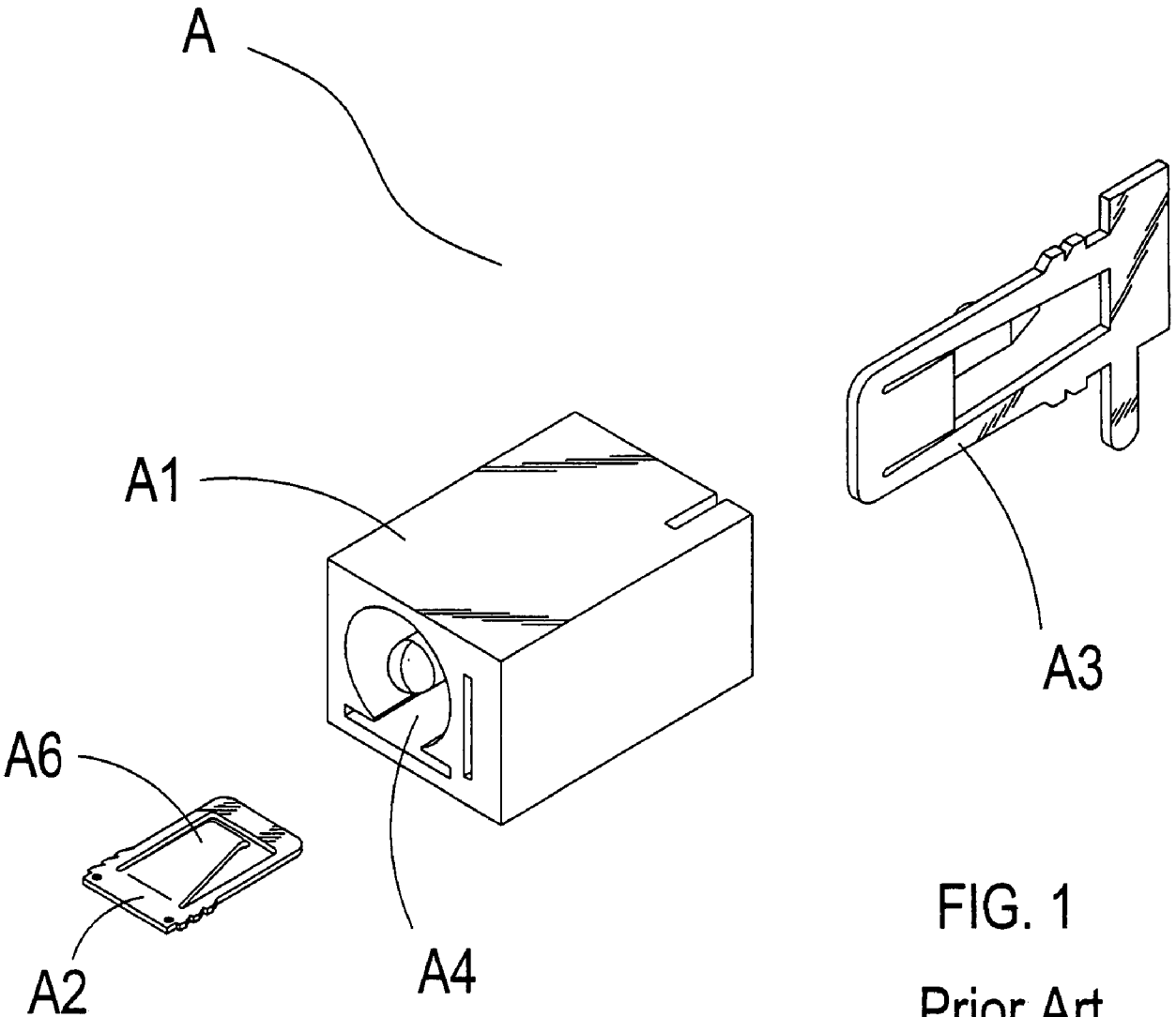
FIG. 1 Prior Art
FIG. 1 shows an exploded elevational view of prior art.
Figure 2:
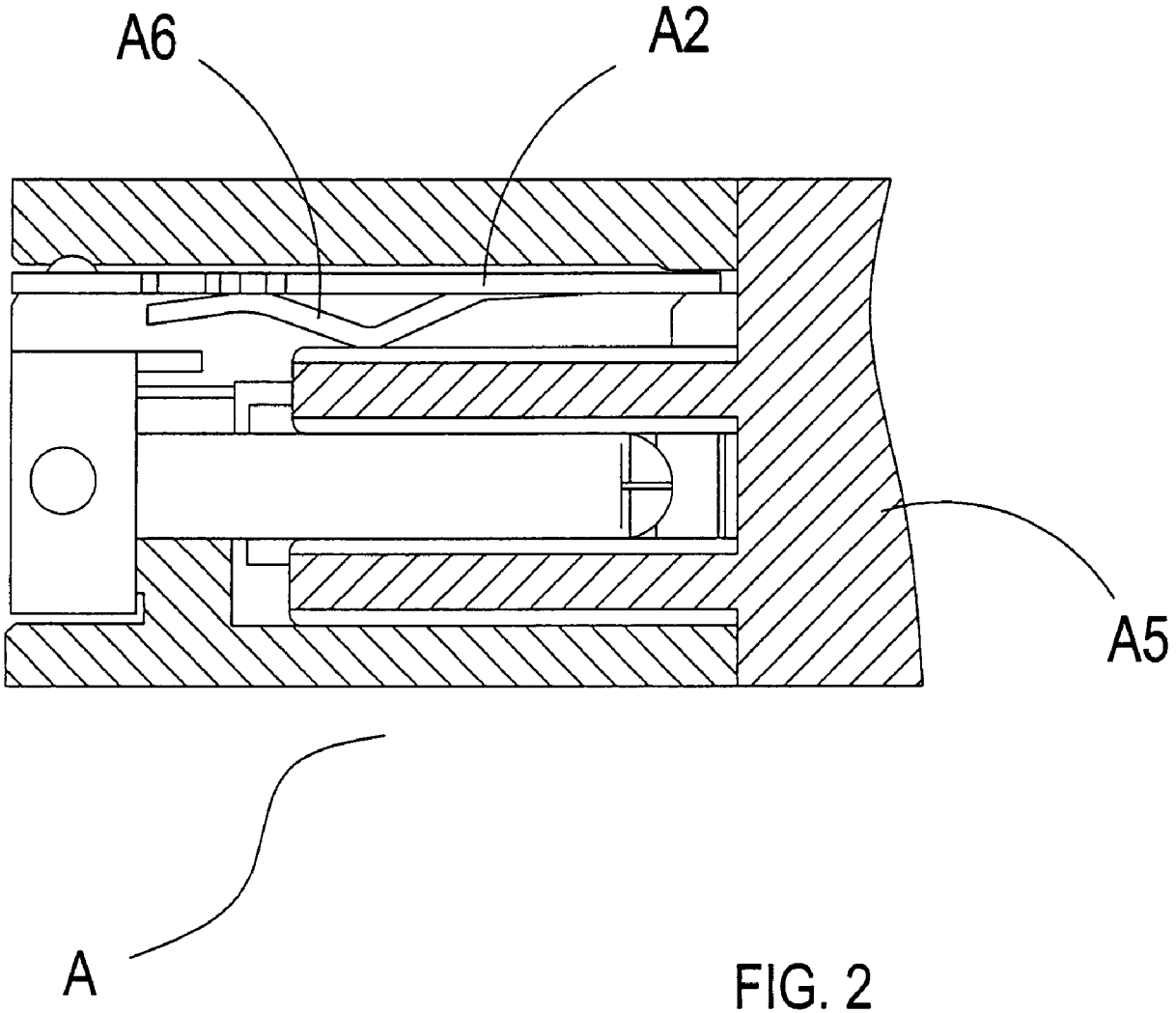
FIG. 2 Prior Art
FIG. 2 shows a cross-sectional view of prior art.
Figure 3:
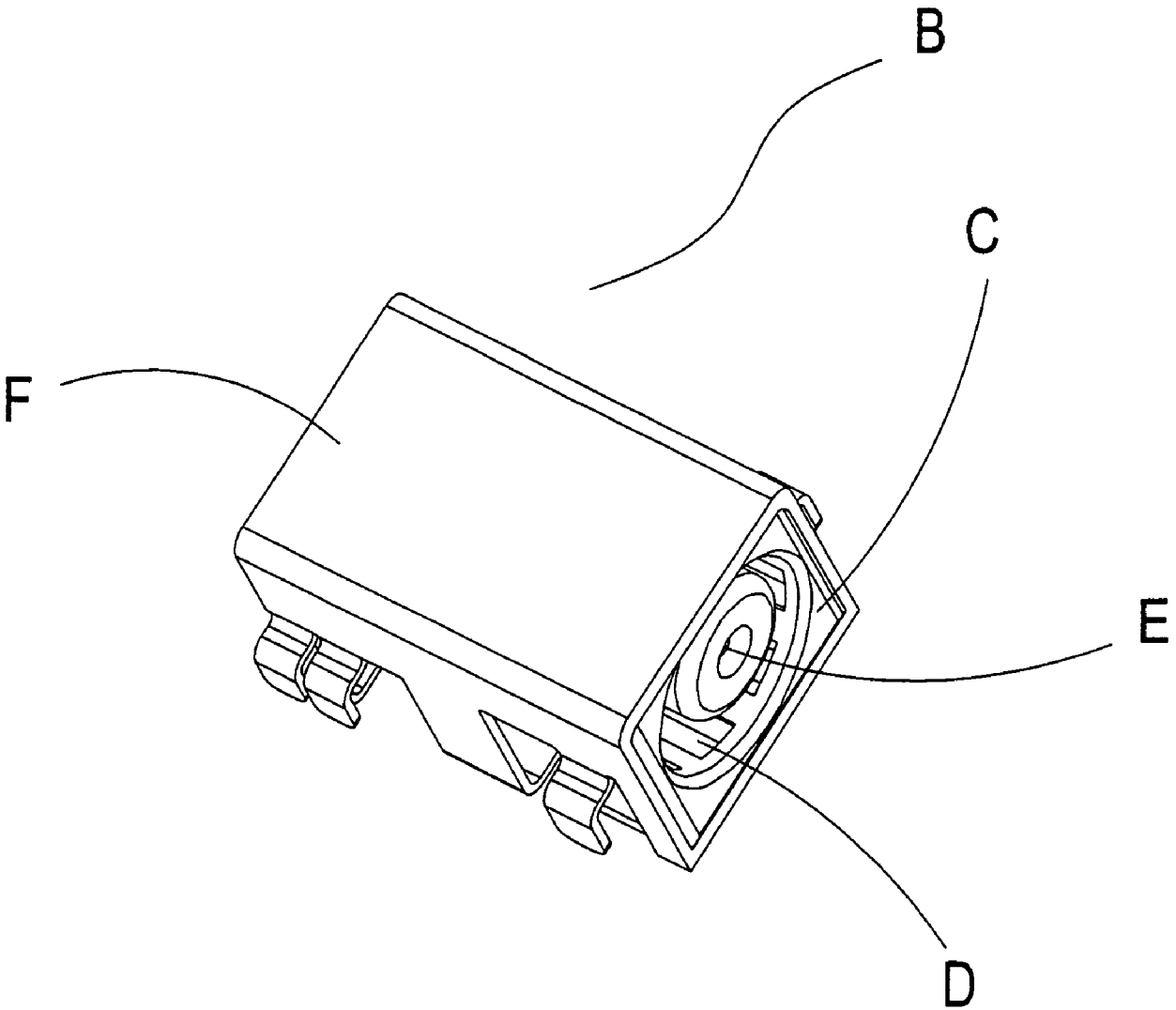
FIG. 3 shows an elevational view according to the present invention.
Figure 4:
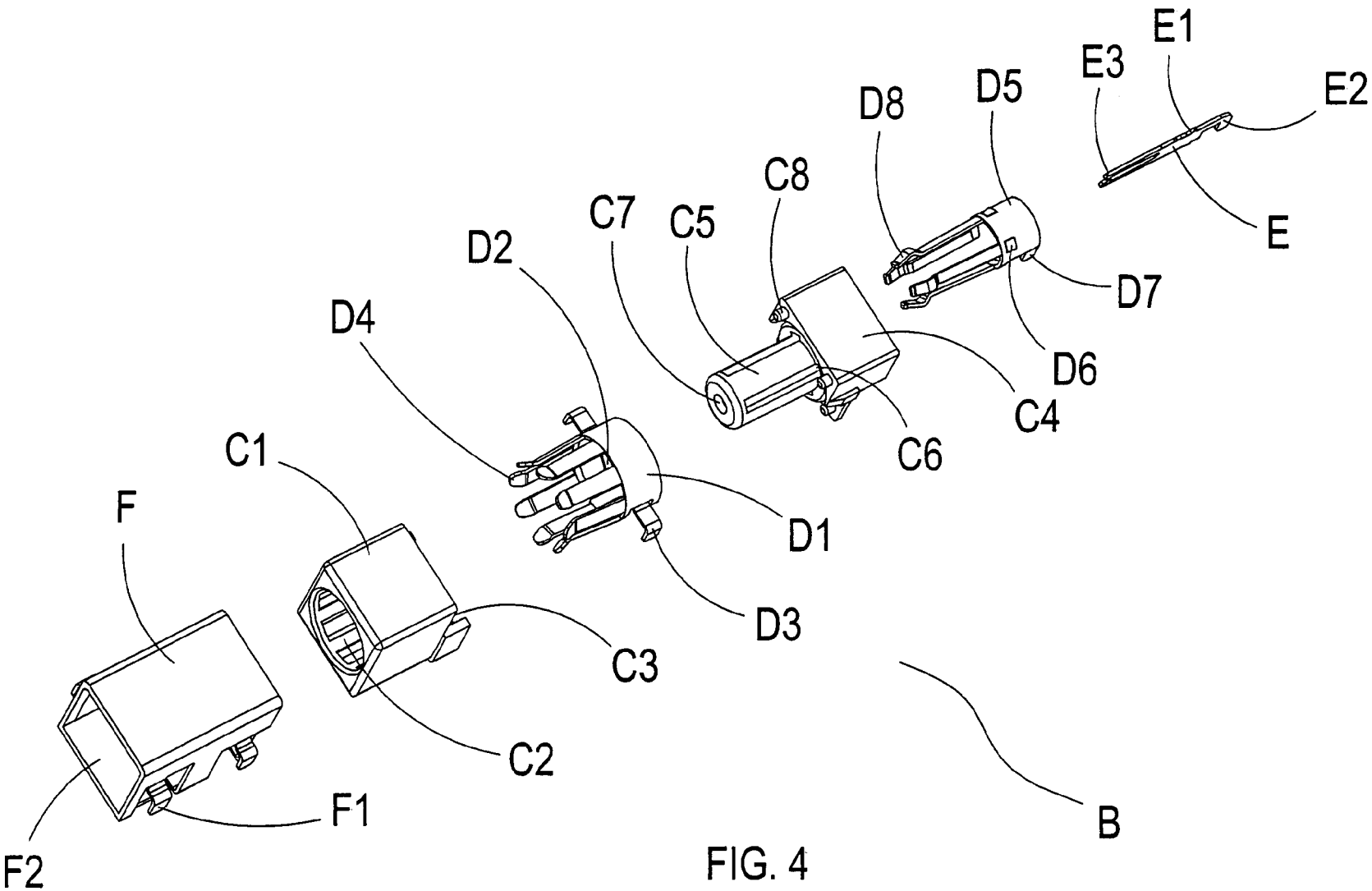
FIG. 4 shows an exploded elevational view according to the present invention.

Referring to FIGS. 3 and 4, which show a power supply connector assembly device of the present invention, wherein a power supply connector B comprises a front insulating body C1 that is used to combine with a first conductive terminal D1, a rear insulating body C4 that is used to combine with a second conductive terminal D5 and a signal terminal E. Moreover, a covering case F is used to cover an insulating body C, interior of which includes an integrated conductive terminal D, thereby achieving the objective of good electrical conductance when the power supply connector B is soldered to a printed-circuit board.

The front insulating body C1 of the power supply connector B includes a holding cavity C2 that is used to hold the first conductive terminal D1, and joining holes C3 that are used to join to correspond joining portions C8 of the rear insulating body C4. Furthermore, the rear insulating body C4 includes a protruding connecting portion C5 that is used to hold the second conductive terminal D5 and the signal terminal E, embedding grooves C6 and a through hole C7. Moreover, the joining portions C8 of the rear insulating body C4 that fit into the corresponding joining holes C3 of the front insulating body C1 fixedly combine the front insulating body C1 and the rear insulating body C4 to form an integrated body.

Furthermore, the first conductive terminal D1 comprises holding slots D2 that are used to hold the protruding connecting portion C5, solderable and conductive soldering portions D3 and contact portions D4. The second conductive terminal D5 comprises clasp portions D6 corresponding to the embedding grooves C6, solderable and conductive soldering portions D7 and contact portions D8. Furthermore, the signal terminal E comprises an inverted hook E1 that can be used to embed and join, and solderable and conductive soldering portions E2 and contact portions E3.

The covering case F comprises a holding space F2 that is used to hold the conductive terminal D. When the insulating body C including the conductive terminal D is contained within the holding space F2, then the power supply connector B can be soldered to a printed-circuit board using soldering portions F1 of the covering case F, the soldering portions D3 of the first conductive terminal D1, the soldering portions D7 of the second conductive terminal D5 and the soldering portions E2 of the signal terminal E, thereby achieving the objective of enabling a power connector A to achieve a stable connection and conducting of electric power.

Figure 5:
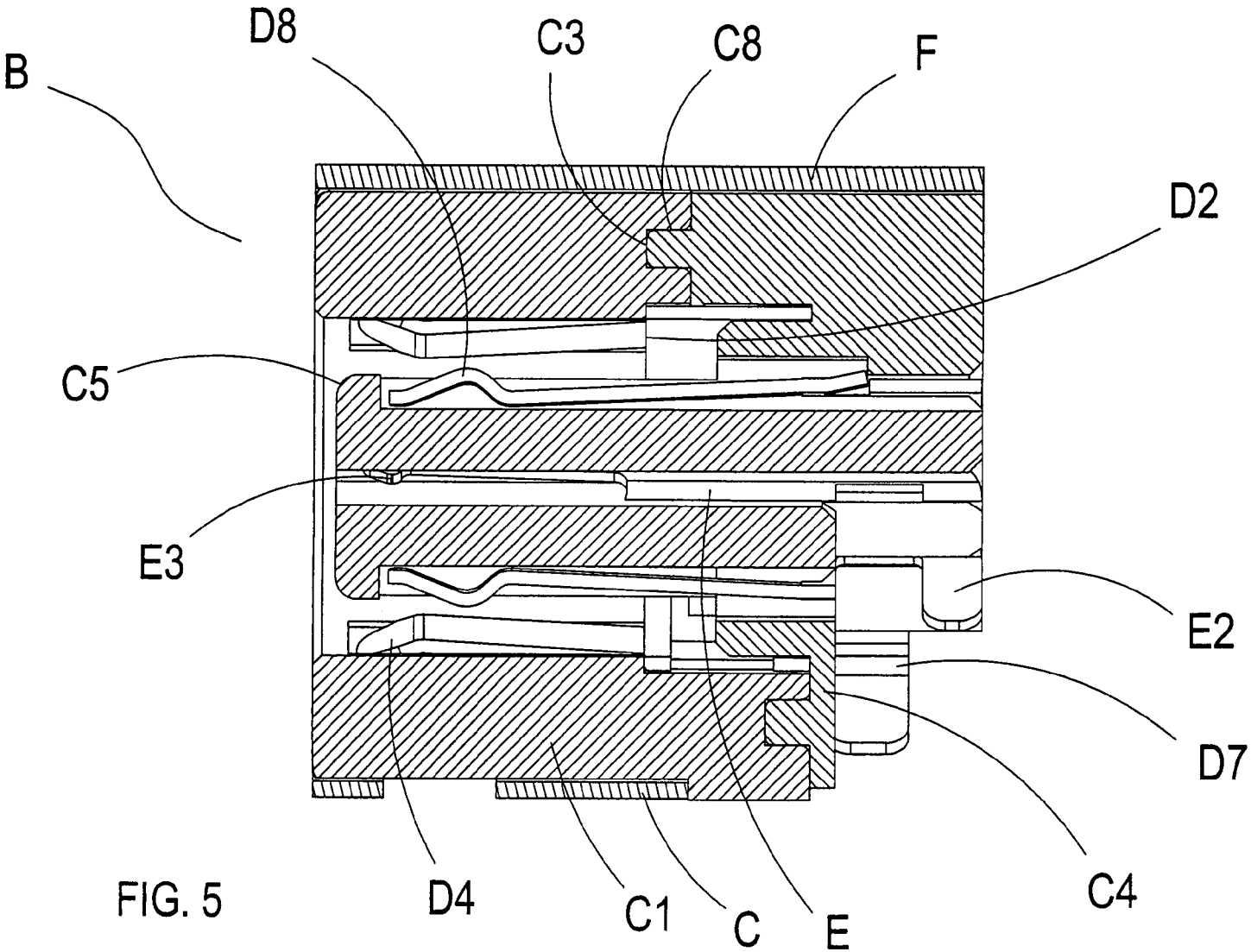
FIG. 5 shows a cross-sectional view according to the present invention.
Figure 6:
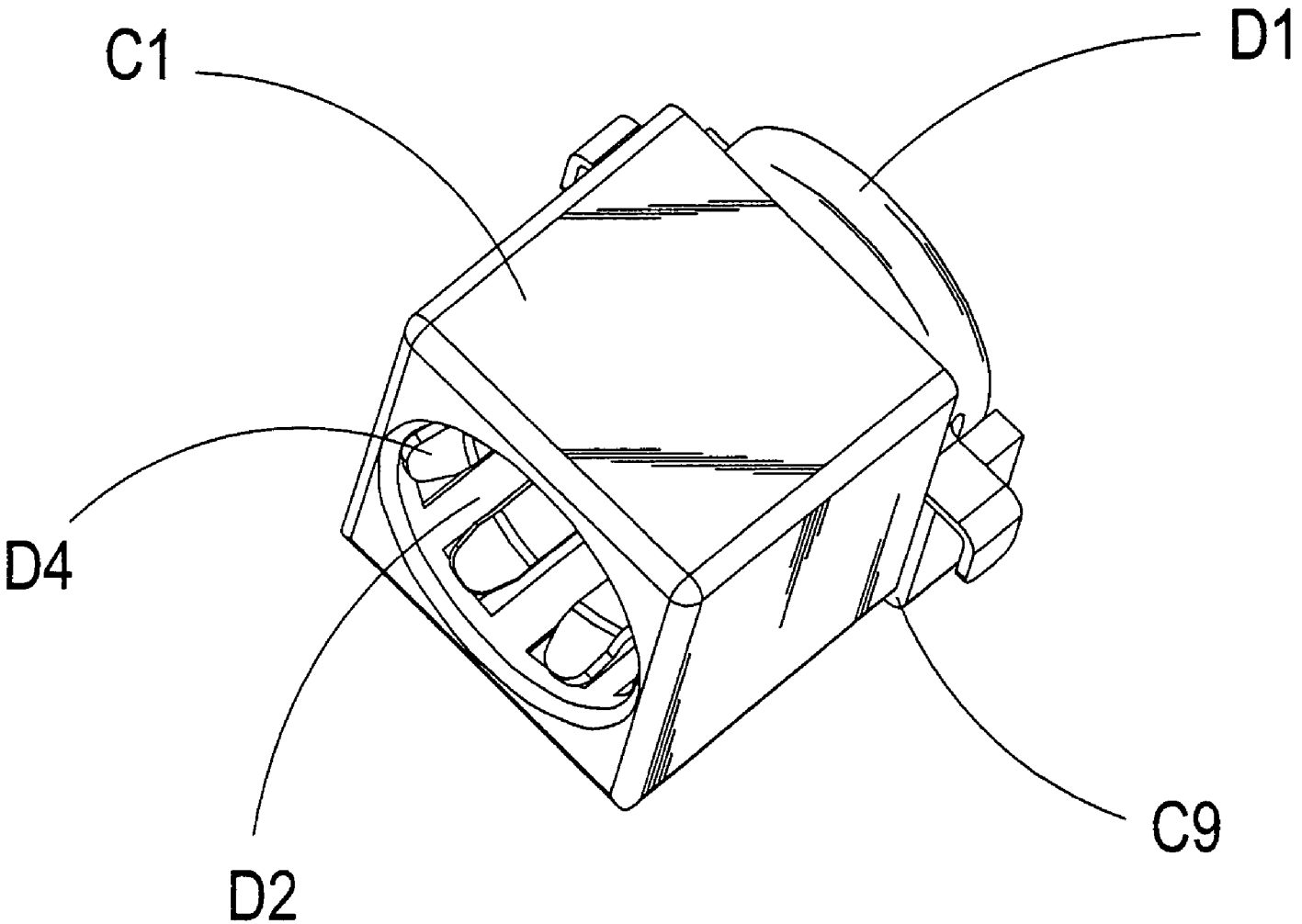
FIG. 6 shows a partial schematic view according to the present invention.
Figure 7:
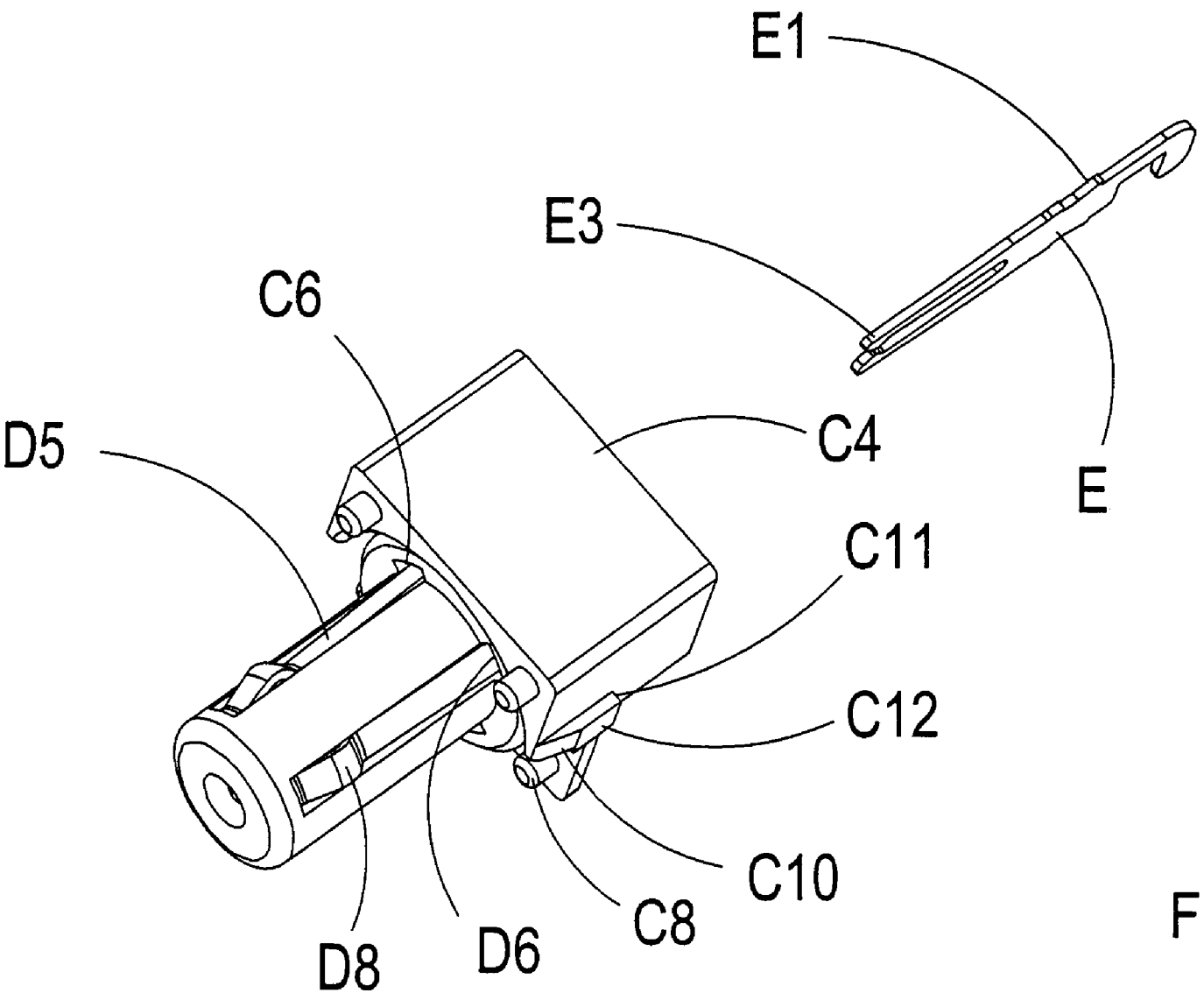
FIG. 7 shows another partial schematic view according to the present invention.

Referring to FIGS. 5, 6 and 7, which show an embodiment of the present invention, wherein after the insulating body C and the covering case F are joined together, then the front insulating body C1 and the rear insulating body C4 are fixedly combined together to from an integrated body by means of the joining holes C3 of the front insulating body C1 and the connecting portions C8 of the rear insulating body C4. Moreover, when the front insulating body C1 is combined with the covering case F, the front insulating body C1 is secured within the covering case F by means of check portions C9 on side surfaces of the front insulating body C1, which prevent the front insulating body C1 from sliding out.

Furthermore, when the rear insulating body C4 and the covering case F are joined together, guide portions C10 of the rear insulating body C4 and check portions C11 of the guide portions C10 are able to fixedly combine together the rear insulating body C4 and the covering case F to form an integrated body. When the rear insulating body C4 and the covering case F are joined together, the rear insulating body C4 is smoothly disposed within the covering case F by means of inclined surfaces C12 of the guide portions C10, and the check portions C11 of the guide portions C10 prevent the rear insulating body C4 from sliding out.

The first conductive terminal D1 comprises the holding slots D2 that enable the protruding portion C5 to embed therein, and the solderable and conductive soldering portions D3 and contact portions D4. The second conductive terminal D5 comprises the clasp portions D6, and the solderable and conductive soldering portions D7 and contact portions D8. Furthermore, the signal terminal E comprises check portions E1 that are used for combining with the insulating body C4 by embedding therein, and the solderable and conductive soldering portions E2 and the contact portions E3.

The first conductive terminal D1 and the second conductive terminal D5 are annular flexible bodies. Moreover, annular surfaces of the annular flexible first conductive terminal D1 and the second conductive terminal D5 provide good flexible support. When the first conductive terminal D1 and the second conductive terminal D5 are embedded into and thereby combined with the front insulating body C1 and the rear insulating body C4 respectively, then the power supply connector B can be soldered to a printed-circuit board, thereby producing a good conductive contact between the first conductive terminal D1 and the second conductive terminal D5.

Figure 8:
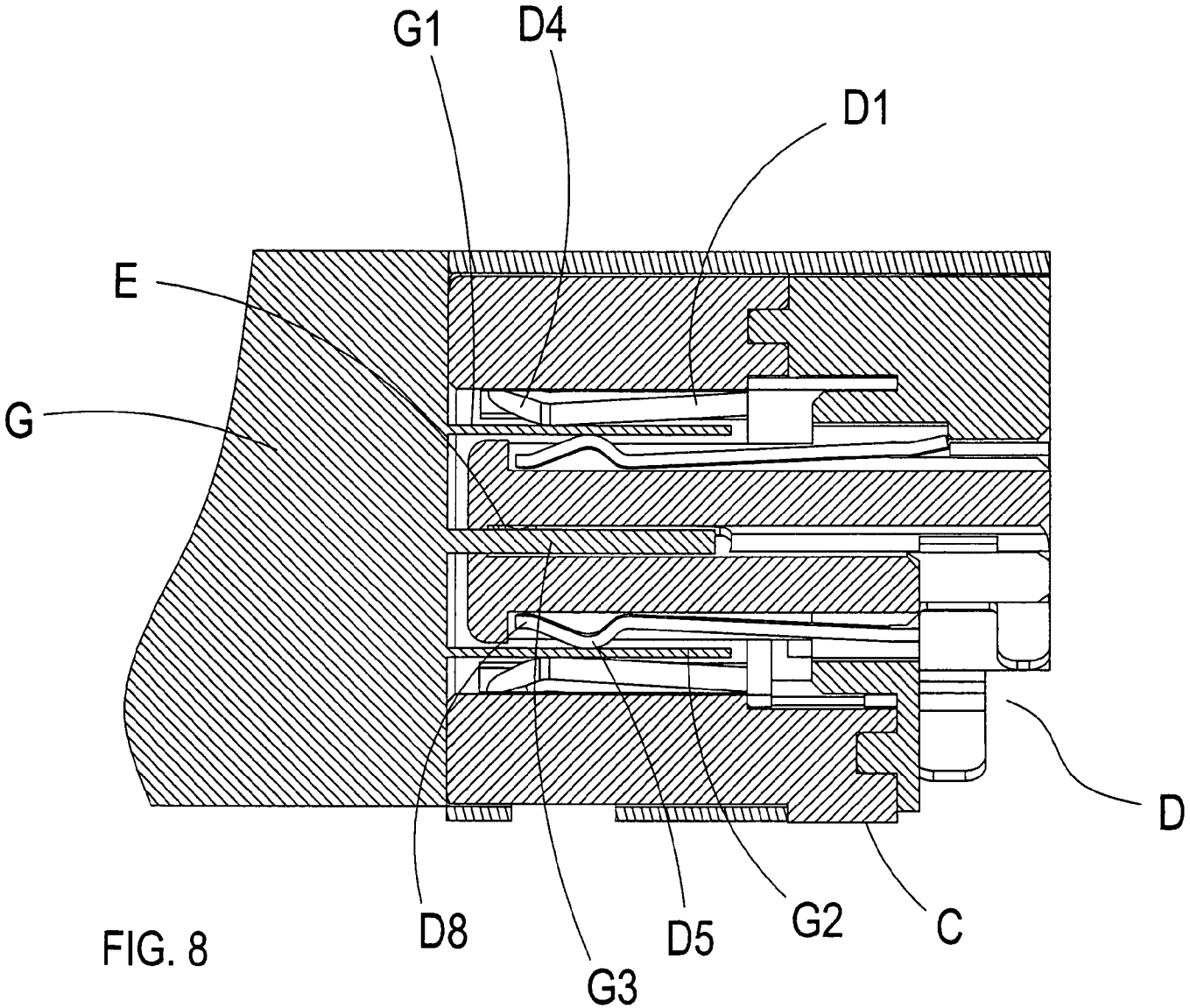
FIG. 8 shows a cross-sectional view of an embodiment according to the present invention.

Referring to FIG. 8, when the power supply connector B makes contact with an electric plug G, then the first conductive terminal D1 makes contact with outer layer conductive portions G1, the second conductive terminal D5 makes contact with inner layer conductive portions G2 and a connecting portion G3 protruding from a center of the electric plug G is clamped within the signal terminal E, thereby embedding the power supply connector B within the electric plug G and achieving the objective of electric conductance and signal transmission.

After the contact portions D4 of the first conductive terminal D1 and the contact portions D8 of the second conductive terminal D5 joined within the insulating body C have made contact with the inner and outer layer conducting portions G1, G2 of the electric plug G, then an electrical contact is made between the power supply connector B and the electric plug G, and a good contact is achieved between the first conductive terminal D1 and the second conductive terminal D5 without causing deformation in the conductive terminal D.

In order to better explicitly disclose advancement and practicability of the present invention, a comparison with prior art is described hereinafter:

Shortcomings of prior art:

1. A first conductive body and a second conductive body of the conventional power supply connector are separately connected conductive contact portions.

2. Because of shortcoming 1, thus, deformation of the contact portions easily results after plugging and unplugging multiple times.

3. Because of shortcoming 1, thus, poor conductive contact easily results when connecting.

4. Because of shortcoming 1, thus, the power supply connector is unable to achieve good electrical conductance when connected.

Advantages of the present invention:

1. The first conductive terminal D1 and the second conductive terminal D5 are bodies that are combined to form an integrated body.

2. Support from support portions of the insulating body C achieves the objective of realizing a firm contact.

3. Because of advantage 2, thus, deformation of the contact portions D4, D8 is prevented.

4. Simplifies the assembling process of the conductive terminals D1, D5, thereby improving production efficiency.

5. Increases stable conductive transmission of power by the conductive terminals D1, D5.

6. Provided with advancement and practicability.

7. Enhances commercial competitiveness.

In conclusion, the present invention in overcoming structural shortcomings of prior art has assuredly achieved effectiveness of anticipated advancement, and, moreover, is easily understood by persons unfamiliar with related art. Furthermore, contents of the present invention have not been publicly disclosed prior to this application, and practicability and advancement of the present invention clearly comply with essential elements as required for a new patent application. Accordingly, a new patent application is proposed herein.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A power supply connector assembly device comprising front and rear insulating bodies, first and second conductive terminals, a signal terminal and a covering case, wherein a power supply connector comprises a front insulating body and a rear insulating body; the front insulating body is designed with a holding cavity that is used to hold the first conductive terminal, and the first conductive terminal comprises holding slots that hold a protruding portion formed central of the rear insulating body, embedding grooves are defined on the protruding portion that enable the second conductive terminal to embed therein, and a through hole is further defined in the protruding portion that provides for the signal terminal to clamp therein;

when joining together the front insulating body and the rear insulating body, joining holes defined in the front insulating body and joining portions formed on the rear insulating body are used to fixedly combine the front insulating body and the rear insulating body to form an integrated body, and the two insulating bodies are then clamped and enclosed within a covering case, thereby enabling the power supply connector to achieve the objective of conducting electric power.

2. The power supply connector assembly device according to claim 1, wherein the first conductive terminal held within the front insulating body comprises solderable and conductive soldering portions and contact portions that are able to make contact with conductive portions of an electric plug, when the conductive portions of the electric plug have made contact with the contact portions of the first conductive terminal, the power supply connector is thus able to achieve the objective of conducting electric power.

3. The power supply connector assembly device according to claim 1, wherein the second conductive terminal embedded within the rear insulating body comprises clasp portions that are able to embed and join, and contact portions that are able to make contact with conductive portions of an electric plug, when the conductive portions of the electric plug have made contact with the contact portions of the second conductive terminal, the power supply connector is thus able to achieve the objective of conducting electric power.

4. The power supply connector assembly device according to claim 1, wherein the signal terminal clamped and joined to the protruding portion comprises an inverted hook that can be used for fastening and contact portions that can be used for clamping and connecting, when an electric plug has made contact with the signal terminal, inner and outer layer conductive portions configured in the electric plug enable the power supply connector to achieve the objective of signal transmission.

5. The power supply connector assembly device according to claim 1, wherein solderable and conductive soldering portions are respectively configured on the covering case, the conductive terminals and the signal terminal, when the solderable and conductive soldering portions of the covering case, the conductive terminals and the signal terminal are respectively soldered to a printed-circuit board, contact portions of conductive portions of an electric plug enable achieving the objective of conducting of electric power and signal transmission between the power supply connector and the electric plug.

* * * * *